US011897083B2

(12) United States Patent
Hemes et al.

(10) Patent No.: US 11,897,083 B2
(45) Date of Patent: Feb. 13, 2024

(54) ROBOTIC PAINT REPAIR SYSTEMS AND METHODS

(71) Applicant: 3M INNOVATIVE PROPERTIES COMPANY, St. Paul, MN (US)

(72) Inventors: Brett R. Hemes, Woodbury, MN (US); John W. Henderson, St. Paul, MN (US); Erich A. Mielke, St. Paul, MN (US); Lucas D. Crestik, Roseville, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 393 days.

(21) Appl. No.: 17/279,726

(22) PCT Filed: Oct. 23, 2019

(86) PCT No.: PCT/IB2019/059071

§ 371 (c)(1),
(2) Date: Mar. 25, 2021

(87) PCT Pub. No.: WO2020/084523

PCT Pub. Date: Apr. 30, 2020

(65) Prior Publication Data

US 2021/0394336 A1 Dec. 23, 2021

Related U.S. Application Data

(60) Provisional application No. 62/750,497, filed on Oct. 25, 2018.

(51) Int. Cl.

| | |
|---|---|
| ***B24B 41/00*** | (2006.01) |
| ***B24B 49/16*** | (2006.01) |
| ***B24D 9/08*** | (2006.01) |

(52) U.S. Cl.
CPC ..... *B24B 41/002* (2013.01); *B24B 49/16* (2013.01); *B24D 9/08* (2013.01)

(58) Field of Classification Search
CPC ..... B24B 41/002; B24B 49/16; B24B 49/12; B24B 19/26; B24B 21/006;
(Continued)

(56) References Cited

U.S. PATENT DOCUMENTS 4,012,839 A 3/1977 Hill
4,753,048 A * 6/1988 Asada ..... B25J 15/0019 451/28

(Continued)

FOREIGN PATENT DOCUMENTS

CN 104259991 1/2015
DE 202013101858 7/2013

(Continued)

OTHER PUBLICATIONS

Volder, "Pneumatic and hydraulic microactuators: a review," J. Micromech Microeng, 2010, vol. 20, 18 pages.

(Continued)

*Primary Examiner* — David B. Thomas
(74) *Attorney, Agent, or Firm* — Aleksander Medved

(57) ABSTRACT

A robotic paint repair system that can comprise: a consumable abrasive product configured to abrade a substrate, a tool configured to drive the consumable abrasive product to abrade, a robotic device configured to manipulate the tool and a compliant accessory actuator positioned between the tool and the substrate, wherein the compliant accessory actuator is driven to apply a desired force and a desired stiffness to the consumable abrasive product in response to sensed data collected between the tool and the substrate.

20 Claims, 10 Drawing Sheets

(58) Field of Classification Search
CPC ... B24B 27/0038; B24B 27/033; B24B 51/00; B24D 9/08; B05D 5/005
See application file for complete search history.

(56) References Cited

U.S. PATENT DOCUMENTS

| | | | | |
|---|---|---|---|---|
| 5,448,146 | A | 9/1995 | Erlbacher | |
| 6,250,999 | B1 | 6/2001 | Pineau et al. | |
| 6,264,534 | B1 * | 7/2001 | Panyard | B24B 49/16 451/24 |
| 6,461,161 | B1 | 10/2002 | Ngo et al. | |
| 7,628,829 | B2 * | 12/2009 | Woo | B24D 9/08 451/526 |
| 8,517,799 | B2 * | 8/2013 | Panergo | B24B 27/0038 451/28 |
| 10,035,237 | B2 * | 7/2018 | Panergo | B24B 41/04 |
| 11,383,344 | B2 * | 7/2022 | Guha | B25J 11/0065 |
| 2002/0156130 | A1 | 10/2002 | Melman | |
| 2006/0028041 | A1 | 2/2006 | Ono et al. | |
| 2007/0235133 | A1 | 10/2007 | Benassi | |
| 2007/0243794 | A1 | 10/2007 | Mundt | |
| 2009/0186556 | A1 | 7/2009 | Hermann | |
| 2013/0109277 | A1 | 5/2013 | Panergo et al. | |
| 2014/0138355 | A1 | 5/2014 | Yavelberg | |
| 2014/0154954 | A1 | 6/2014 | Hunt | |
| 2016/0144484 | A1 * | 5/2016 | Simon | B24B 55/06 451/490 |
| 2017/0066106 | A1 | 3/2017 | Bosio et al. | |
| 2018/0158707 | A1 | 6/2018 | Hunter et al. | |
| 2021/0394328 | A1 * | 12/2021 | Hemes | B24B 49/12 |

FOREIGN PATENT DOCUMENTS

| | | |
|---|---|---|
| DE | 102016106141 | 10/2017 |
| JP | 03234460 | 10/1991 |
| WO | WO2016/145472 | 9/2016 |
| WO | WO2018/092889 | 5/2018 |
| WO | WO2020/084411 | 4/2020 |
| WO | WO2020/084517 | 4/2020 |

OTHER PUBLICATIONS

Liu,"A flexible and highly sensitive pressure sensor based on elastic carbon foam," Journal of Material Chemistry C, 2018, vol. 6, pp. 1451-1458.

Smartfoam-Pressure, XO-NANO, 2021, [retrieved from internet on May 24, 2021], URLhttp://xonanosmantfoam.com/smartfoam-pressure/, 2 pages.

International Search report for PCT International Application No. PCT/IB2019/059071 dated May 26, 2020, 7 pages.

* cited by examiner

ROBOTIC PAINT REPAIR SYSTEMS AND METHODS

CROSS REFERENCE TO RELATED APPLICATIONS

This application is a national stage filing under 35 U.S.C. 371 of PCT/IB2019/059071, filed Oct. 23, 2019, which claims the benefit of U.S. Provisional Application No. 62/750,497, filed Oct. 25, 2018, the disclosures of which are incorporated by reference in their entireties herein.

TECHNICAL FIELD

This disclosure relates to abrading tools and consumable abrasive products, and more particularly, to robotically implemented repairs using abrading tools and consumable abrasive products.

BACKGROUND

Abrading tools and associated consumable abrasive products are used in numerous industries. For example, consumable abrasive products are used in the woodworking industries, marine industries, automotive industries, construction industries, and so on. Common abrading tools include orbital sanders, random orbital sanders, belt sanders, angle grinders, die grinders, and other tools for abrading surfaces. Consumable abrasive products can include nonwoven abrasive products, sanding disks, sanding belts, grinding wheels, burrs, wire wheels, polishing discs/belts, deburring wheels, convolute wheels, unitized wheels, flap discs, flap wheels, cut-off wheels, and other products for physically abrading workpieces. Consumable abrasive products are consumable in the sense that they can be consumed and replaced much more frequently than the abrading tools with which they are used. For instance, a grinding wheel for an angle grinder can only last for a few days of work before needing to be replaced, but the angle grinder itself can last many years. In the automotive industry, defect-specific repairs for paint applications (e.g., primer sanding, clear coat defect removal, clear coat polishing, etc.) are accomplished using abrading tools and associated consumable abrasive products. Clear coat repair is one of the last operations to be automated in the automotive original equipment manufacturing (OEM) sector. Techniques are desired for automating this process as well as other paint applications (e.g., primer sanding, clear coat defect removal, clear coat polishing, etc.) amenable to the use of abrasives and/or robotic inspection and repair. Additionally, this problem has not been solved in the aftermarket sector (e.g. custom car modifications, DIY, detailing, and collision repair).

To date, defect-specific repairs for paint applications in the automotive industry remains a manual endeavor.

SUMMARY

Various examples are now described to introduce a selection of concepts in a simplified form that are further described below in the Detailed Description. The Summary is not intended to identify key or essential features of the claimed subject matter, nor is it intended to be used to limit the scope of the claimed subject matter.

This disclosure describes systems, methods and techniques related to various problems in automating defect-specific repairs for paint applications. For example, robotic paint repair (material removal and subsequent polishing) is not trivial to automate with the key issue being that both process actions are inherently force-dependent. That is, they require precise applied forces during processing to obtain optimal (or even sufficient) results. Robotic manipulators, due to their historical drive for ever increasing precision, are inherently stiff systems that, by themselves, cannot produce significant force control fidelity. With the addition of some advanced force sensing and reactive control loops/algorithms it is possible to have the robot manipulators apply controlled forces to the workpiece but the systems in general still suffer from high stiffness (i.e., small positional displacements result in large changes of joint torques and thus large forces at the end effector). As a solution to the above, the current state-of-the art consists of attaching softer redundant actuation between the robot and the tool. This added compliance reduces force-displacement curves and results in systems that can precisely control applied forces over a particular displacement.

Traditional robotic force compliance devices make no assumptions on the tool and are intended to reside between the robot flange and effector/tool. While desirable for the sake of application generality, this approach results in significantly large masses in the force control system (i.e., flange plus any tooling). However, the present inventors have recognized herein systems, methods and techniques that represent improvements on the current state of the art. For example, they have designed task-specific force control with significantly less inertial mass and ultimately much higher performance. In particular, the present inventors propose systems, methods and techniques that move the compliant force control actuation from between the robot and tool (sander and polisher in this case) to between the tool and the substrate. Put another way, the compliant accessory actuator can be positioned between the tool and the substrate (e.g., on or within the tool, a backup pad, a consumable abrasive product, another component of the tool stack, in a dedicated device, etc.). The compliant accessory actuator can be driven to apply a desired force and a desired stiffness to the consumable abrasive product in response to sensed data collected between the tool and the substrate. This arrangement results in the system not having to drive masses on the order of kilograms, instead the system now only has to drive the compliant accessory actuator which can be much smaller, on the order of grams (three orders of magnitude difference from traditional compliant accessory actuators in other systems). The backup pad or polishing pad can become the actuator via the inclusion of internal pressure chambers, for example. These internal pressure chambers can be chambers encapsulated by some deformable material (e.g., closed cell foam). Chambers can be arranged in a multitude of different configurations to ensure proper force ranges and angular/lateral stiffness of the tool (e.g., to achieve appropriate vertical/in-line compliance with limited-to-no off-axis deformation). Force control can be achieved via any appropriate pneumatic methods. Air can be delivered at any stage of the (random) orbital tool via slip rings or similar. As an example, implementation force can be measured at the robot flange and used as a control signal to a high-speed pressure control loop that drives the compliant accessory actuator.

According to other examples, the inventors propose novel methods of measuring force and other characteristics on a spinning tool. This can be done utilizing one of the many low power, wireless (Bluetooth, wifi, RF, etc.) sensor processors available, one could measure characteristics about the tool even in spinning components. In one example, a multi-sensor component was put into a sealed deformable elastomeric container and placed in a recess formed in the backup pad. A pressure sensor that is part of the multi-sensor component changed as force was applied to the backup pad. Squeezing the foam of the backup pad, subsequently resulted in squeezing the deformable container and increasing the relative pressure, which was measured by the pressure sensor. Knowing applied pressure and/or other sensed properties using the multi-sensor component the inventors can derive force and other characteristics of the spinning tool for control and other purposes. The measured properties can also be used for machine learning and/or in other algorithms for useful purposes (e.g., improved robotic control, improved repair results, etc.).

According to yet other examples, the present inventors propose systems, methods and techniques whereby material deformation, particularly electrical characteristics, are used to measure applied force and/or other characteristics. For example, with a wireless, low power sensor similar to that described above, monitoring of capacitance between two films separated by the backup pad foam within the backup pad can occur. As mean distance changes so would capacitance. Additionally or alternatively, a conductive particle loaded foam or similar material can be utilized in the backup pad, and this material can have a resistance that changes as a function of density. Applying pressure to the backup pad densifies the material and lowers the resistance. Utilizing, for example, a simple voltage divider circuit, the inventors have communicated the force and other properties applied to the backup pad (or other deformable component in the tool stack) to a processor for computation/feedback control.

The details of one or more examples of the disclosure are set forth in the accompanying drawings and the description below. Other features, objects, and advantages of the disclosure will be apparent from the description, drawings, and claims.

The disclosure herein includes but is not limited to the following illustrative Examples:

Example 1 is a robotic paint repair system that can comprise: a consumable abrasive product configured to abrade a substrate, a tool configured to drive the consumable abrasive product to abrade, a robotic device configured to manipulate the tool and a compliant accessory actuator positioned between the tool and the substrate, wherein the compliant accessory actuator is driven to apply a desired force and a desired stiffness to the consumable abrasive product in response to sensed data collected between the tool and the substrate.

Example 2 is the robotic repair system of Example 1 optionally further comprising: a pressure supply, a backup pad configured to couple with the consumable abrasive product, and a pressure controller coupled with the pressure supply, wherein the compliant accessory actuator is driven by a pneumatic pressure from the pressure supply to apply the desired force and the desired stiffness to the consumable abrasive product, and wherein the pressure controller is configured to measure an implementation force of the robotic device and is configured to control the pneumatic pressure within the pressure supply based upon the implementation force.

Example 3 is the robotic repair system of Example 2, wherein the implementation force can be measured at a flange between the robotic device and the tool.

Example 4 is robotic repair system of Example 3, optionally further comprising a sensor configured to couple to one of the backup pad, the tool and the flange.

Example 5 is the robotic repair system of any one of claims 1-4, wherein the compliant force actuator can comprise a plurality of internal pressure chambers encapsulated by a deformable material, and wherein the plurality of internal pressure chambers can be arranged in a multitude of different configurations to achieve the desired force and desired stiffness.

Example 6 is the robotic repair system of Example 5, wherein the desired force can comprise a range, and wherein the desired stiffness can comprise one or more of an angular stiffness and a lateral stiffness.

Example 7 is the robotic repair system of any one or combination of Examples 2-6, wherein the pressure supply can be one of internal to or external of the tool.

Example 8 is the robotic repair system of any one or combination of Examples 1-7, wherein the robotic device can be directly coupled to the tool with no intermediate component.

Example 9 is the robotic repair device of any one or combination of Examples 1-8, optionally further comprising a sensor positioned in the backup pad and configured to measure a force exerted on the backup pad.

Example 10 is a system that can optionally comprise: a consumable abrasive product configured to abrade a substrate, a tool configured to drive the consumable abrasive product to abrade, a backup pad configured to couple with the consumable abrasive product, and a sensor mounted to the backup pad and spin therewith when driven by the tool, wherein the sensor is configured to measure operation related data of the backup pad that occurs during abrading the substrate with the consumable abrasive product.

Example 11 is the system of Example 10, wherein the backup pad can have a recess therein, wherein the sensor can be disposed in the recess in the backup pad and sealed within a deformable volume at a first relative pressure, and wherein the operation related data can include one or more of an applied force on, an applied pressure on, an applied magnetic field on, an applied acceleration on, a resistance of, a capacitance of and a rotational speed of the backup pad.

Example 12 is the system of Examples 11, wherein the backup pad can be formed of a deformable material that deflects under the applied force, and whereby the deformation of the backup pad causes a squeezing of the deformable volume within the recess thereby increasing a pressure within the deformable volume from the first relative pressure to a second relative pressure.

Example 13 is the system of any one or combination of Example 11-12, wherein the deformable volume is formed of an elastomeric material.

Example 14 is the system of any one or combination of Examples 10-13, wherein the sensor can be powered by a battery that is charged by energy harvesting as a result of the spinning and vibration of the backup pad.

Example 15 is the system of any one or combination of Examples 10-14, optionally further comprising a processor communicating wirelessly with the sensor.

Example 16 is the system of any one or combination of Examples 10-15, optionally further comprising a processor configured to determine a strain across the backup pad as a function of a change in density of the backup pad.

Example 17 is the system of Example 16, wherein the strain can be determined as a function of a change in capacitance between at least to films as measured in a first state with a first amount of force is applied to the backup pad and a second state where a second force is applied to the backup pad, wherein the at least two films can be separated by a deformable foam of the backup pad.

Example 18 is the system of Example 16, wherein the strain can be determined as a function of a change in resistance of a conductive particle foam where a resistance of the conductive particle foam changes as a function of a change in density of the conductive particle foam.

Example 19 is the system of any one of Examples 10-18, further comprising: a robotic device configured to manipulate the tool, wherein the robotic device can be configured to change an operation or a parameter related to manipulation of the tool based on data derived from the measured one or more of the applied force on, the applied pressure on, the applied magnetic field on, the applied acceleration on, the resistance of, the capacitance of and the rotational speed of the backup pad.

Example 20 is the system of Example 19, wherein the robotic device, the tool, the consumable abrasive product, and the backup pad can comprise first components of a tool stack, and optionally further comprising a deformable component that comprises another component of the tool stack and a second sensor within the deformable component, wherein the second senor is configured to measure one or more of a resistance of and a capacitance of the deformable component.

DETAILED DESCRIPTION

Figure 1:
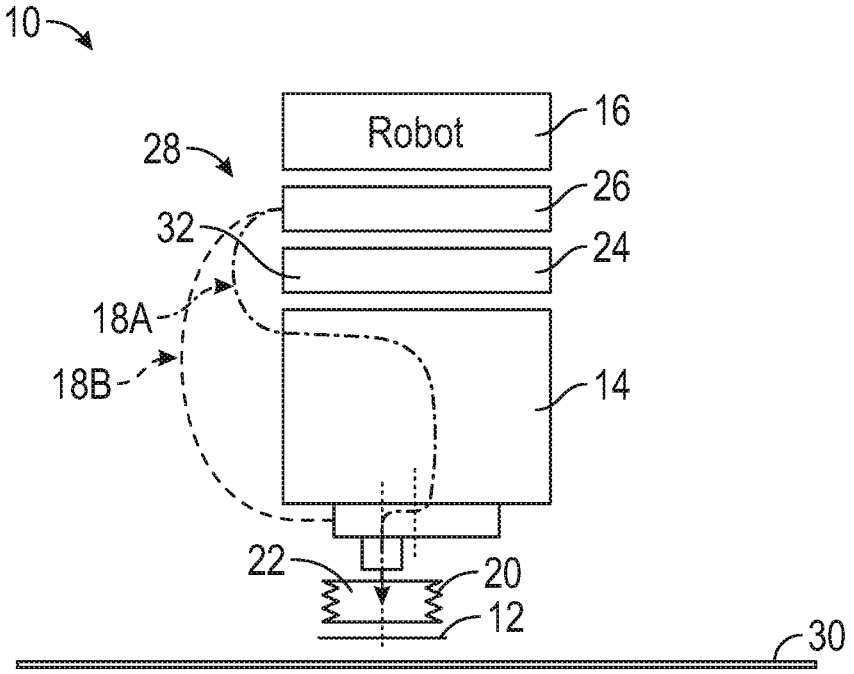
FIG. 1 is a schematic diagram illustrating an example system for robotic paint repair in accordance with one example of the present application.

Abrading tools and associated consumable abrasive products present various challenges for individuals and organizations. In one example, over time workers frequently develop an intuitive sense of when a workpiece is of desired quality or when a consumable abrasive product is wearing out. However, a robot using an abrading tool may not acquire such an intuitive sense. Various techniques, systems and methods are disclosed herein to more accurately control robot manipulation of the abrading tool to achieve more desirable results (i.e., more accurate and desirable abrading of substrate to remove paint in one example).

It should be understood that although an illustrative implementation of one or more embodiments are provided below, the disclosed systems and/or methods described with respect to FIGS. 1-13 may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

The functions or algorithms described herein may be implemented in software in one embodiment. The software may consist of computer executable instructions stored on computer readable media or computer readable storage device such as one or more non-transitory memories or other type of hardware-based storage devices, either local or networked. Further, such functions correspond to modules, which may be software, hardware, firmware or any combination thereof. Multiple functions may be performed in one or more modules as desired, and the embodiments described are merely examples. The software may be executed on a digital signal processor, ASIC, microprocessor, or other type of processor operating on a computer system, such as a personal computer, server or other computer system, turning such computer system into a specifically programmed machine.

According to one aspect of this disclosure, a system is disclosed that includes sensor and/or communication-equipped tool stack. Such sensor and/or communication-equipped apparatuses can include an abrading tool, backup pad and/or consumable abrasive product (CAP). According to one example as described herein, data gathered by sensor (s) in the tool stack or from adjacent the tool stack (e.g. by visual inspection and/or from sensor(s) on the substrate and/or robot) can be utilized for automating the process of repairing defects for paint applications using automated abrasive processing and subsequent polishing. The disclosed techniques, systems and methods can include novel combinations of robotic (smart) tools, sensing techniques, stochastic process policy that results in desired system behavior based on current part/system state and provided feedback, and an optional learning component capable of optimizing provided process policy, continuously adapting the policy due to customer's upstream process variations, and/or learning the process policy from scratch with little-to-no human intervention. Although described in reference to repairing defects for paint applications the techniques, methods and systems disclosed can be utilized in other abrading applications.

According to one aspect of the present application, the system includes a computing system that is configured to: receive data from a communication unit regarding a property measured by a sensor or derived indirectly from other data, the data can be indicative of at least one operating parameter of the tool stack (i.e. of the abrading tool, the backup pad, and/or the CAP). The system can use the data for control/feedback to guide manipulation of the tool stack by the robot.

FIG. 1 is a highly schematic diagram of a system 10 that can be used for robotic paint repair. The system 10 can include a consumable abrasive product 12, an abrading tool 14, a robotic device 16, a pressure supply 18A or 18B, a backup pad 20 and a compliant accessory actuator 22, sensor(s) 24 and a pressure controller 26. As used herein the consumable abrasive product 12, the abrading tool 14, the pressure supply 18A or 18B, the backup pad 20, the compliant accessory actuator 22, sensor(s) 24 and the pressure controller 26 can comprise a tool stack 28. The tool stack 28 is more or less synonymous with the term end effector; however, in this document the term "stack" is the end effector in the context of robotic paint repair. Also, though described for providing robotic paint repair, which includes repair of primer, paint, and clear coats, it will be appreciated that the techniques described herein lend themselves to other industrial applications beyond paint repair.

Importantly, the system 10 of FIG. 1 does not include a large compliant force/pressure control apparatus as is typical in the industry. Rather, the system 10 can have the robotic device 16 directly coupled to the abrading tool 14 with no intermediate component in some examples.

The consumable abrasive product 12 can be configured to abrade a substrate 30. As discussed, in one application of the system 10 can be for defect-specific repairs for paint applications (e.g., primer sanding, clear coat defect removal, clear coat polishing, etc.). Thus, the consumable abrasive product 12 can be configured for this sanding and buffing applications. The tool 14 can be coupled to and configured to drive the consumable abrasive product 12 to abrade the substrate 30. The robotic device 16 can be coupled to and configured to manipulate the tool 14. Thus, the robotic device 16 can move the tool 14 within a three dimensional spaced as desired while the tool 14 is operable to drive the consumable abrasive product 12 to abrade. The pressure supply 18A or 18B can fluidly couple between components of the tool stack 28. In the example of FIG. 1, the pressure supply 18A or 18B can be coupled at a first end to backup pad 20, and in particular, the compliant accessory actuator 22. At another portion the pressure supply 18A or 18B can fluidly couple with the pressure controller 26. The pressure controller 26 can be configured to regulate pneumatic pressure within the pressure supply 18A or 18B.

The pressure supply 18A can be internal to the abrading tool 14. The pressure supply 18B can be external to the abrading tool 14. Either example is contemplated. Thus, the pressure delivery can be around tool (with pressure supply 18B) or through tool (with pressure supply 18A).

According to the example of FIG. 1, the pressure controller 26 can be configured to measure an implementation force of the robotic device 16 and can be configured to control the pneumatic pressure within the pressure supply 18A or 18B based upon the implementation force. This can result in an altered stiffness for the backup pad 20, and hence, a change in stiffness for the tool stack 28 due to changes in the pressure within the compliant accessory actuator 22.

The sensor(s) 24 can be part of the tool stack 28 and can be disposed in various locations such as in the backup pad 20, the consumable abrasive product 12, the abrading tool 14, etc. For simplicity, the sensor(s) 24 are shown as a separate item in the example of FIG. 1 and is measured at a flange 32 of the robotic device 16. Thus, in one example the implementation force (force exerted on the tool stack 28 by the robotic device 16) can be measured at the flange 32 of the robotic device 32. However, other locations for the sensor(s) 24 are described herein such as in reference to other of the FIGURES. Thus, in various examples the sensor(s) 24 can be configured to couple to one of the backup pad 29, the abrading tool 14, the flange 32, etc.

The backup pad 20 can be positioned between the consumable abrasive product and the tool 14, for example. The backup pad 20 can be coupled with the consumable abrasive product 12. According to one example, the backup pad 20 can have outer layer(s) with natural rubber or synthetic rubber (for example, urethane rubber or chloroprene rubber) as a main raw material. The backup pad 20 can have an inner layer that can be, for example, a foam body obtained from natural rubber, synthetic rubber or any polymer. The foam body can be a closed cell foam or an open cell foam. Alternatively, the main raw material of the inner layer may be natural rubber or synthetic rubber.

According to further examples, the backup pad 20 can include the foam body of closed cell foam. This can comprise the complaint accessory actuator 22 according to one example. This closed cell foam can have encapsulated chambers. The chambers can be arranged in a multitude of different configurations to ensure proper force ranges and angular/lateral stiffness of the tool (e.g., to achieve appropriate vertical/in-line compliance with limited-to-no off-axis deformation).

As discussed, the complaint accessory actuator 22 can be positioned in the backup pad 20. The compliant accessory actuator 22 can be driven by a pneumatic pressure from the pressure supply to apply a desired force and desired stiffness to the consumable abrasive product 12. In this manner, undesired amounts of force/pressure etc. such as the implementation force discussed above that can result from undesirable manipulation of the robotic device 16 can be absorbed and/or avoided to be transferred to the consumable abrasive product 12 (and hence the substrate 30) by use of the complaint accessory actuator 22. The compliant accessory actuator 22 can be driven by other mechanisms known in the art such as air bladders, spring-damper systems, linear servo motors, or the like.

The backup pad 20 can comprise 3M™ Soft Interface Disc Pad of various diameters, attachment types, etc. According to another example, the backup pad 20 can comprise 3M™ Dual Lock™ PSA Soft Disc Pad of various diameters, for example. According to another example, the backup pad 20 can comprise 3M™ Finesse-it™ Roloc™ Sanding Pad of various diameters, attachment types, etc.

The desired force can comprise a range, a target, a maximum value, a minimum value, for example. The desired stiffness can comprise one or more of an angular stiffness and a lateral stiffness, for example.

In the manual clear-coat repair process, at a high-level, is well known and accepted in the industry. It is a two-step process: abrasion/sanding and polishing/buffing. From an automation perspective, the following inputs and outputs may be of relevance in different embodiments (with examples from the 3M Finesse-it system):

Inputs:
- Shared (sanding and polishing)
  - Tool speed [frequency]
  - Tool orbit [length]
  - Randomness (i.e., random orbital vs. orbital)
  - Path pattern
  - Path speed [velocity]
  - Applied force/pressure
  - Angle (i.e., off normal)
  - Total process time
- Sanding-specific
  - Backup pad
    - Hardness
  - Abrasive Type (e.g., disc)
    - Format
      - e.g., {disc, belt, file belt, etc.}
    - Type
      - e.g., {coated, bonded, nonwoven, Trizact, etc.}
    - Product
      - e.g., {468LA, 366LA, 464LA, 466LA}
    - Grade
      - e.g., {A3, A5, A7, P600, P800, 3000, etc.}
    - Diameter/Scallop
      - e.g., {1¼", 1⅜" scalloped}
    - State
      - Age (e.g., age≈f (pressure, time))
      - Cleanliness (e.g., has the disc been cleaned?)
- Polishing-specific
  - Buffing pad
    - Foam type, density, etc.
      - e.g., {Gray, Orange, Red, Green, White}
    - Diameter
      - e.g., {3¼", 3¾", 5¼"}
    - Surface profile
      - e.g., {flat, egg crate, wool, etc.}
  - Polish
    - Amount
    - Distribution
    - Finish
      - e.g., {FM, P, EF, K211, FF, UF}

Outputs:
- Uniformity
- Roughness
- Gloss percentage
- Time to buff
- Final buff quality (e.g., uniformity, haze, etc.)

Figure 2:
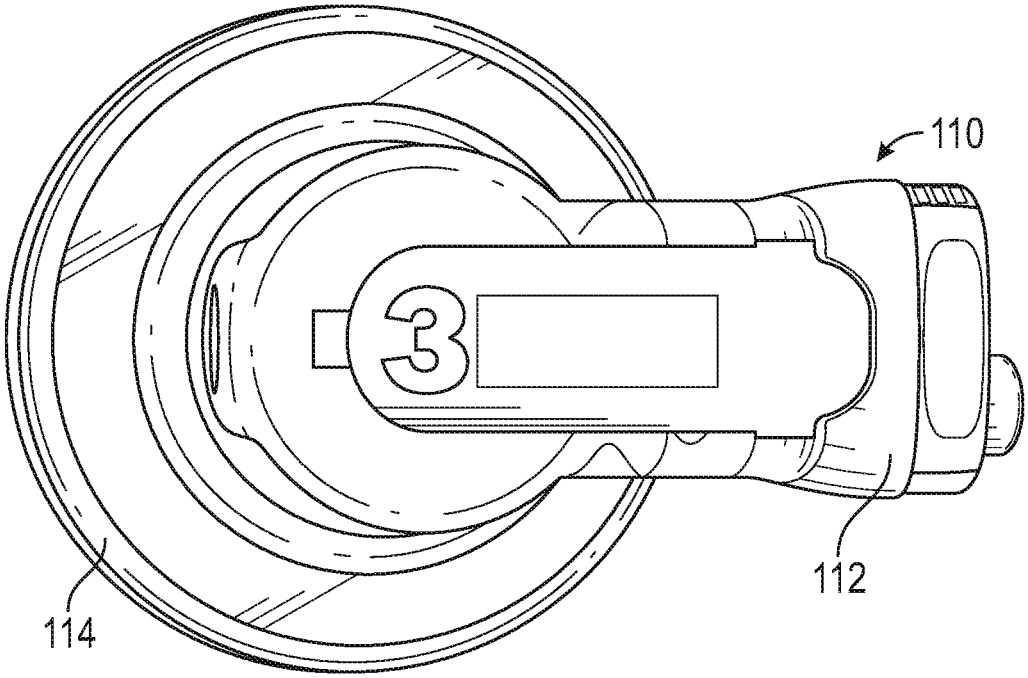
FIG. 2 is a portion of a abrading tool coupled to a backup pad in accordance with one example of the present application.
Figure 3:
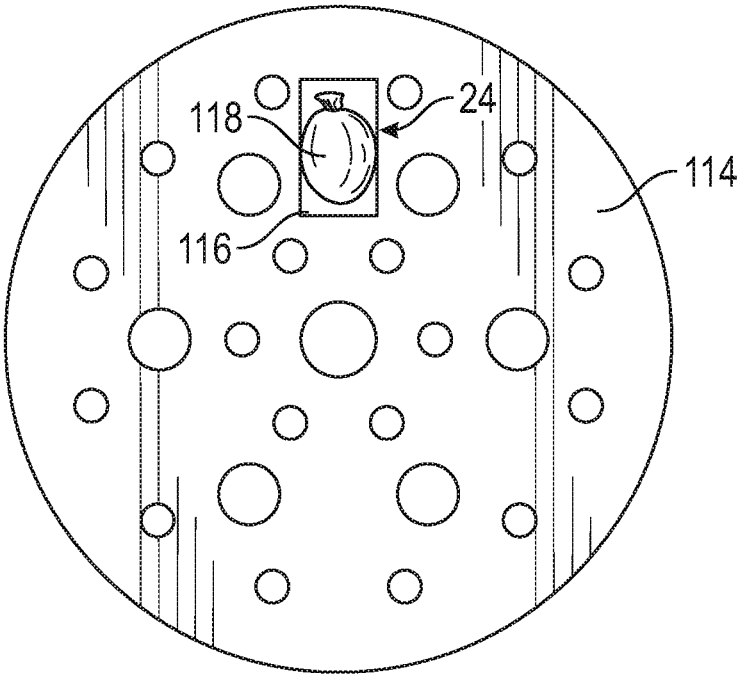
FIG. 3 is the backup pad of FIG. 2 with the abrading tool and portions of the backup pad removed to illustrate the interior of the backup pad in accordance with one example of the present application.

FIG. 2 shows an example of a tool stack 110 including an abrading tool 112 and backup pad 114. The backup pad 114 is another example of a location for sensor(s) 24 as shown in FIG. 3. In particular, in FIG. 3 the sensor(s) 24 are positioned in the backup pad 114. The sensor is in fluid communication with the pressure supply and can be configured to measure a force exerted on the backup pad 114. According to the example of FIG. 3, the backup pad 114 has a recess 116 therein. The sensor(s) 24 can be disposed in the recess 116 in the backup pad 114 as shown in FIG. 3.

Figure 4:
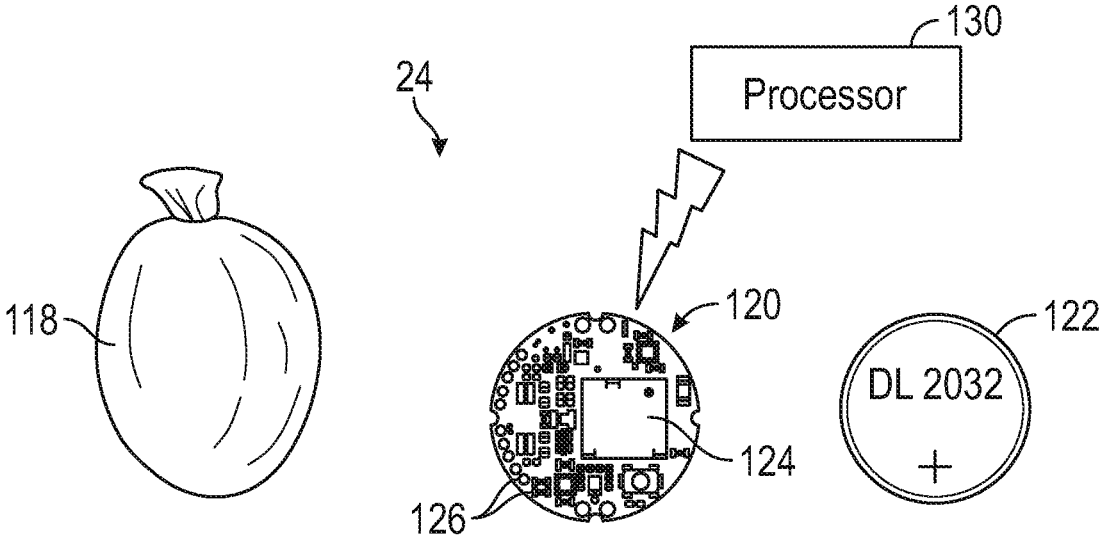
FIG. 4 shows a pressure sealed sensor volume that is insertable within the backup pad and a sensing apparatus and battery that can be placed within the pressure sealed sensor volume in accordance with one example of the present application.
Figure 5:
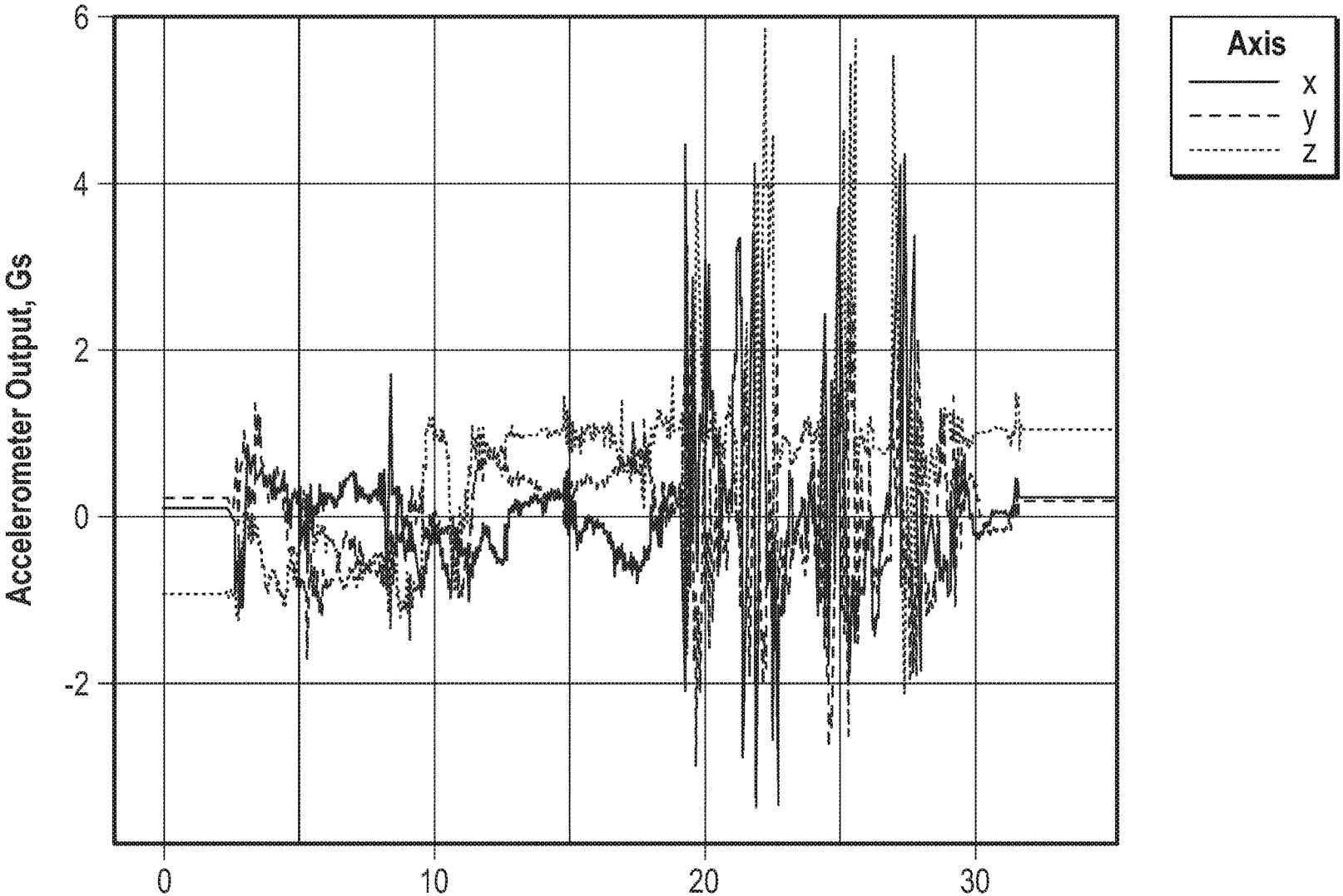
FIGS. 5-8 are plots of various physical criteria such as pressure, magnetometer output, gyroscope output and accelerometer output from the sensing apparatus mounted within the pressure sealed sensor volume within the backup pad, in accordance with one example of the present application.
Figure 6:
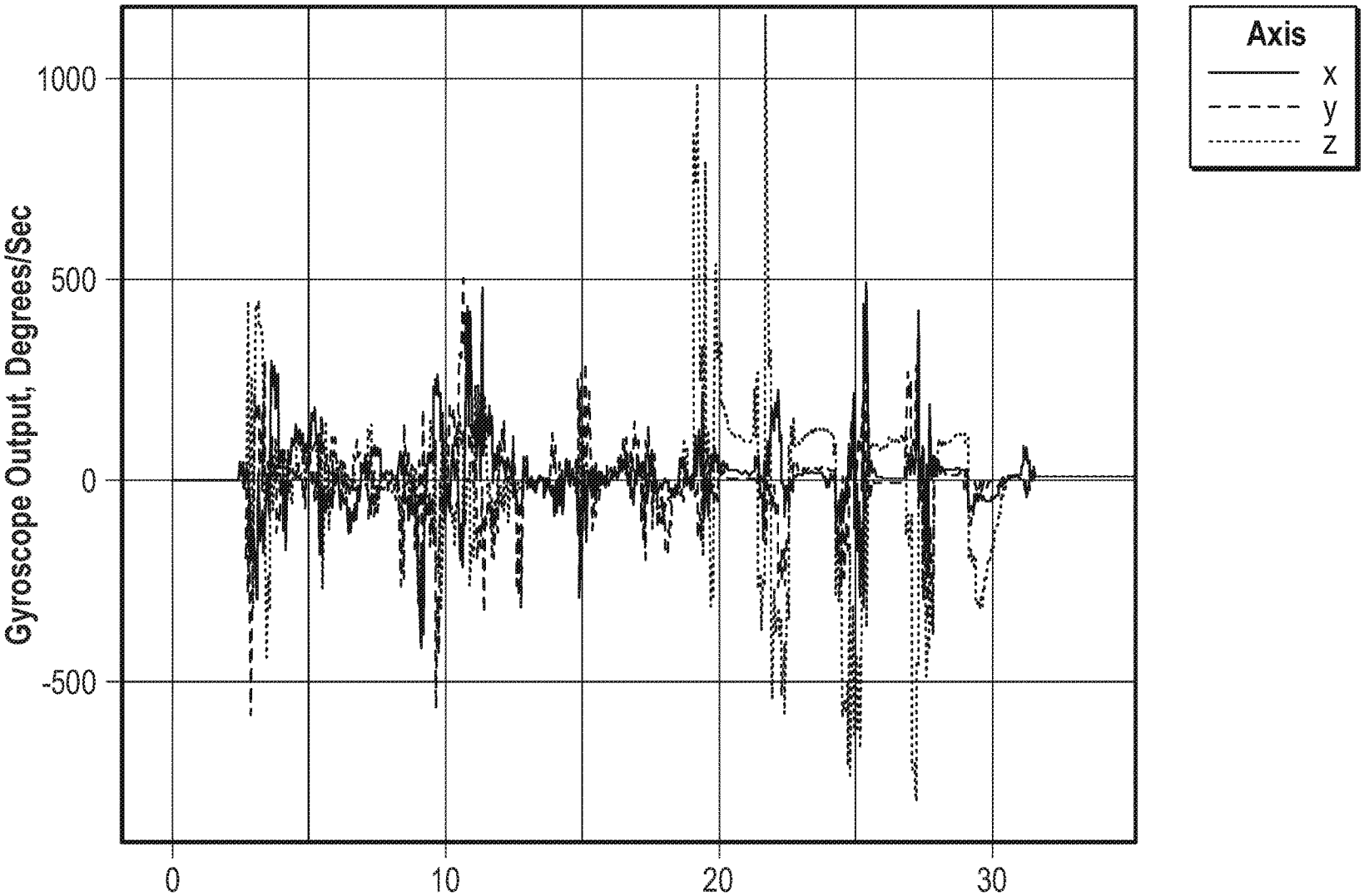
Figure 7:
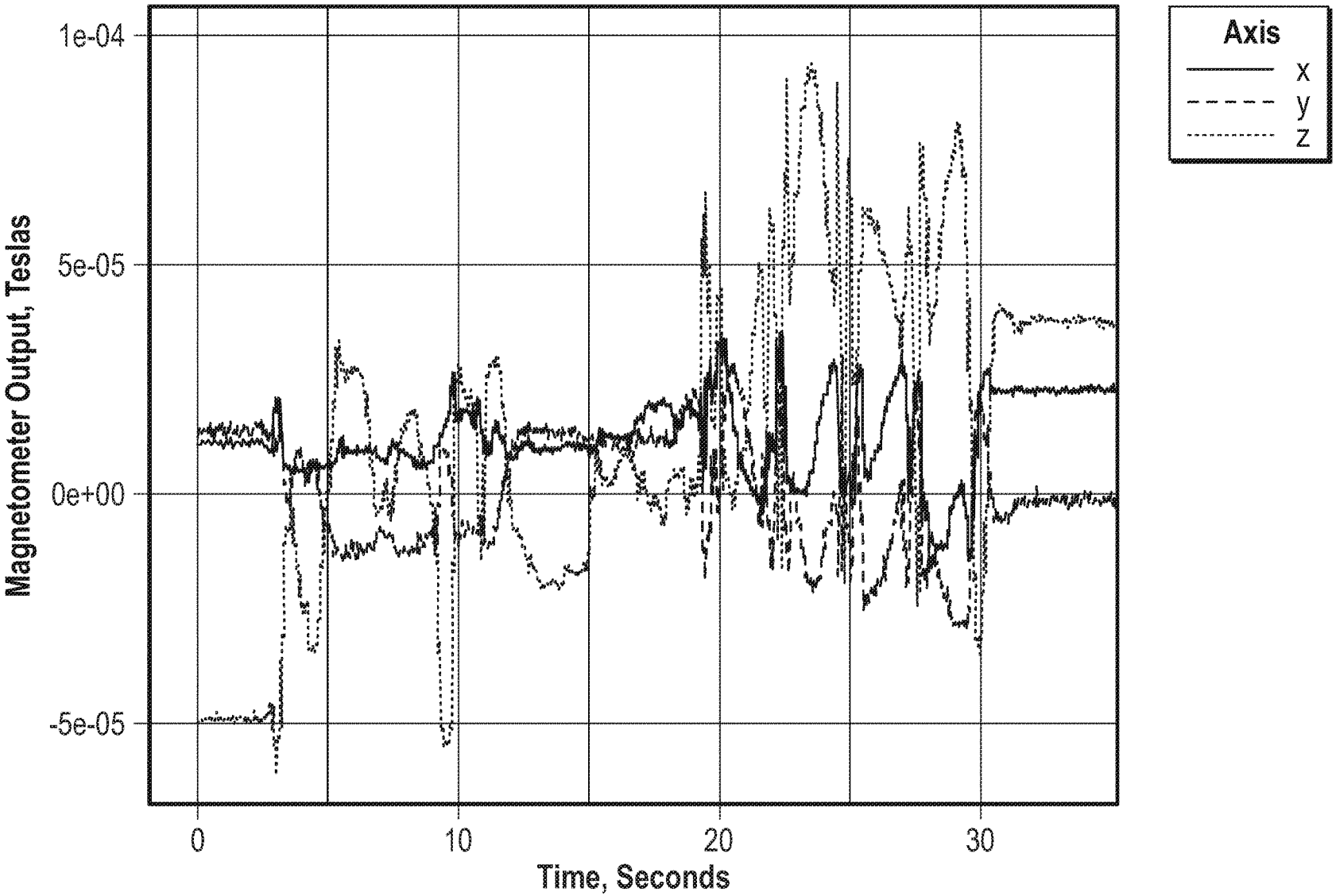
Figure 8:
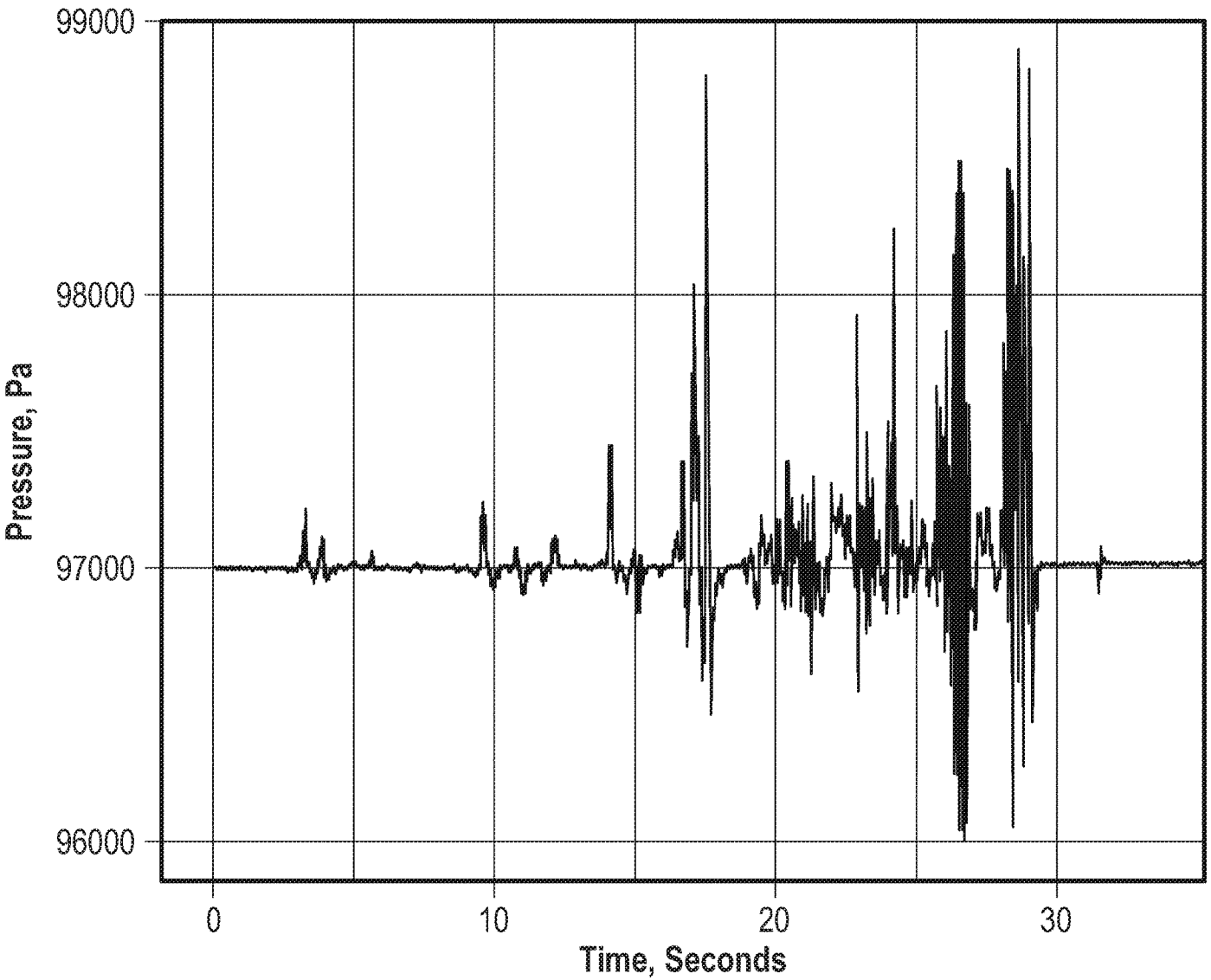

As shown in FIG. 4, the sensor(s) 24 can be sealed within a deformable volume 118. Thus, for example the material that defines the deformable volume 118 can be formed of an elastomeric material, a non-elastomeric with deformable walls, or simply a flexible material. Thus, according to various examples materials contemplated include, but are not limited to nitrile, rubber, polyurethane, elastomeric thermoplastics, for example. This pressure within the deformable volume can be at a first relative pressure that is known prior to the sealing of the volume 118. Returning now to FIG. 3, the backup pad 114 can be formed of a deformable material (e.g., foam) or cavity (air or another gas) that deflects/reduces in size under an applied force. The deformation of the backup pad 114 can cause a squeezing of the deformable volume 118 within the recess 116 thereby increasing a pressure within the deformable volume from the first relative pressure to a second relative pressure. This change in pressure can be measured by the sensor(s) 24 within the volume 118. Knowing applied pressure and/or other sensed properties using the sensor(s) one can derive force and other characteristics of the tool stack 110 for control and other purposes. The measured properties can also be used for machine learning and/or in other algorithms for useful purposes (e.g., improved robotic control, improved repair results, etc.) as further discussed in reference to FIG. 13.

According to one example the sensor(s) 24 can comprise only a barometric sensor. However, as shown in FIG. 4, in other examples the sensor(s) 24 can comprise a multi-sensor apparatus 120 with a processor 124, circuit board 126 and other components such as a battery 122. The multi-sensor apparatus 120 can be configured to capture various types of data regarding the backup pad 114, tool 112 and other components of the tool stack 110 including pressure, force, acceleration, wear, time in use, maximum rotations per minute (RPM), other RPM related data, temperature, torque, resistance, capacitance, etc. In some cases, it can be desirable to capture sensed data indicative of backup pad 114 direction (e.g., magnetometer) and position/orientation (e.g., gyroscope and accelerometer, etc.). Thus, the sensor(s) 24 can be configured to measure one or more of an applied force on, an applied pressure on, an applied magnetic field on, an applied acceleration on, a resistance of, a capacitance of and a rotational speed of the backup pad 114. Communication of this data can be done by wireless modality (Bluetooth, wifi, RF, etc.). Thus, a processor 130 can communicate wirelessly with the sensor(s) 24. The battery 122 is shown as a CR2032 coin-cell in FIG. 4. However, in other examples rechargeable batteries could be utilized. These could utilize wireless charging and energy harvesting techniques due to the high frequency spinning and vibrations within the backup pad 114.

According to one example, the sensor(s) 24 can comprise a MetaWear CPro multi-sensor BLE development board having multiple sensing capabilities. The board includes a barometric sensor, accelerometer, magnetometer and gyroscope, for example. FIGS. 5-8 show plots of pressure, acceleration, magnetic field strength and angular velocity obtained using the MetaWear CPro multi-sensor BLE development board disposed in the foam backup pad of a 6 inch random orbital sander as illustrated in FIGS. 2 and 3. The Dual Action Orbital Sander of FIG. 2 was run while varying the downward force, logging the MetaWear CPro multi-sensor BLE development board's accelerometer, pressure, magnetometer, and gyroscope readings to show that the pulsed force is visible and can be used for input into machine learning or other algorithms for useful purposes including control of the manipulation of a robotic device, determining tool and consumable abrasive product wear, determining run time, etc.

Figure 9A:
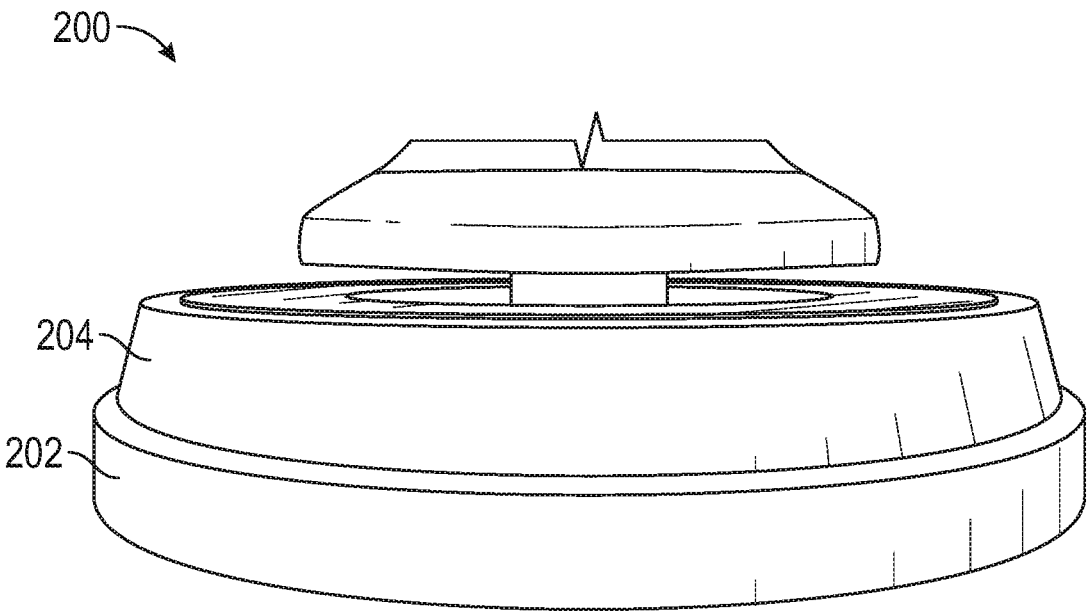
FIGS. 9A and 9B show compression of the backup pad between a first uncompressed state in FIG. 9A to a second compressed state in FIG. 9B, in accordance with one example of the present application.
Figure 9B:
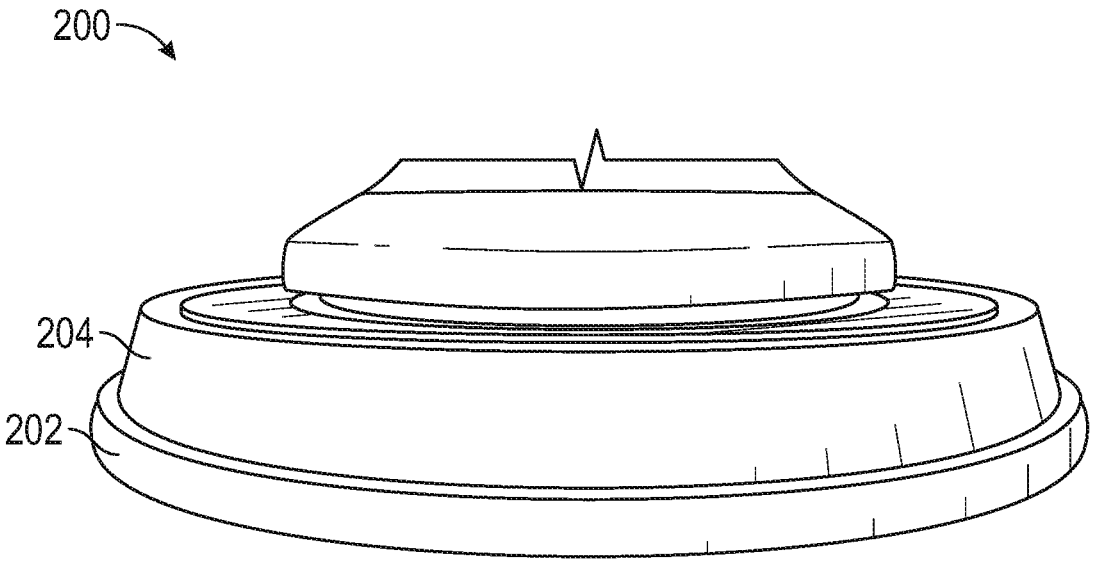

FIGS. 9A and 9B show an abrading tool 200 such as the Dual Action Orbital Sander of FIG. 2 coupled to a backup pad 202 via a backing 204. FIG. 9A shows the backup pad 202 in an undeformed first state with no force applied thereto. FIG. 9B shows the backup pad 202 is a deformed second state with a force applied thereto via the abrading tool 200. As shown in the second state, the backup pad 202 is relatively more dense then in the first state. This change in density can be measurable and can be used to derive other properties such as material strain. From material strain, the force, pressure and other properties can be derived without the need for direct sensing using sensors. Although the techniques discussed in reference to FIGS. 10-12B are described generally with reference to a backup pad, it should be understood that they can be utilized in other components of the tool stack previously illustrated and described in reference to FIG. 1.

Figure 10:
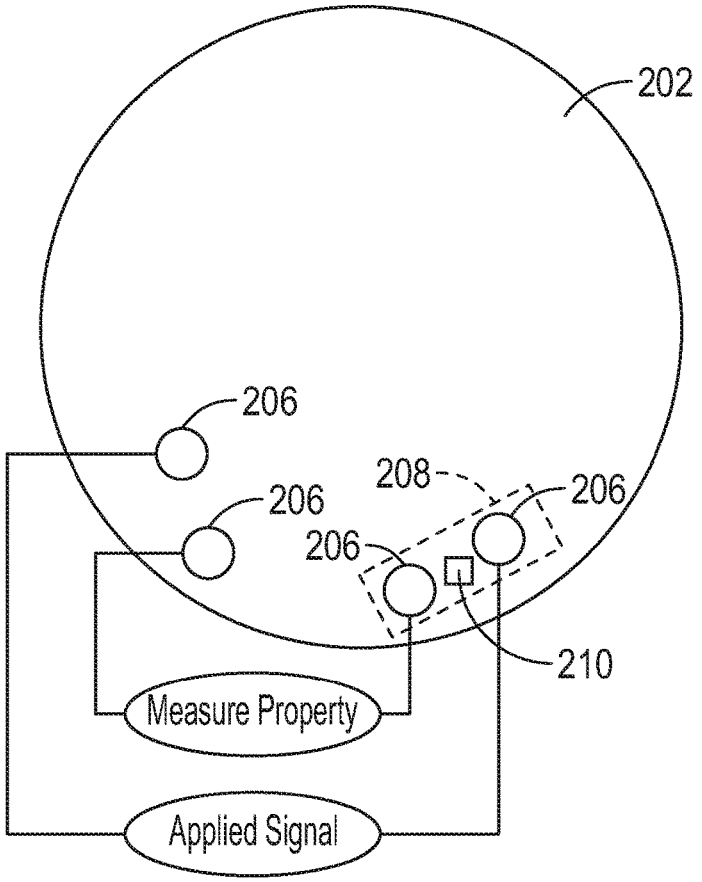
FIG. 10 is a highly schematic view of an example apparatus such as a consumable abrasive product, backup pad or another apparatus that includes electrodes for detecting electrical properties such as resistance, capacitance or inductance from which other physical properties such as density, strain, force, pressure, etc. can be derived in accordance with one example of the present application.

As shown in FIG. 10 the backup pad 202 is illustrated in a highly schematic manner and can be configured in the manner subsequently described in reference to FIGS. 11A, 11B, 12A and 12B. The backup pad 202 can include a foam body as previously described. The backup pad can include electrodes 206 for determining changes in electrical properties such as resistance, capacitance, inductance that result from a change in density in the backup pad 202. From these measured electrical properties, strain on the backup pad 202 can be derived. From the derived strain, other properties such as force and pressure on the backup pad 202 can be derived. Thus, the electrodes 206 can be part of the sensor(s) 24 previously described.

In FIG. 10, a controller 208 can apply an electrical signal to pairs of electrodes (i.e., drive electrodes) while measuring voltage on other pairs (i.e., measurement electrodes). For instance, the controller can apply an electrical signal across a first pair of electrodes and measure a voltage or another electrical property across a second pair of electrodes to generate a set of measurements. Each of the electrodes 206 can serve as a drive electrode or a measurement electrode at different times. When a pair of electrodes are serving as drive electrodes, the controller applies an electrical signal across the pair of electrodes. When a pair of electrodes are acting as measurement electrodes, the controller uses the electrodes to measure a voltage between the two electrodes. In some examples, the measurement electrodes are the same as the drive electrodes. However, using different electrodes as drive electrodes and measurement electrodes can remove contact impedance from the measurement.

The controller can repeat the process of applying electrical signals to pairs of drive electrodes for one or more (e.g., a predetermined) number of pairs of electrodes (other pairs of electrodes not shown in FIG. 10) and in different states (such as the two states shown in FIGS. 9A and 9B) where an applied force value is known. The controller can store the resulting measurements as datasets in a memory. The controller can comprise a microcontroller or other type of integrated circuit according to one example.

Subsequently, the controller can apply an electrical signal to pairs of electrodes while measuring voltage or another electrical property on other pairs. For instance, the controller can be configured to apply a second electrical signal across the first pair of electrodes in the plurality of electrodes and measure a voltage, resistance, capacitance, etc. across the second pair of electrodes to generate a second set of measurements. The controller can repeat this process for one or more (e.g., a predetermined) number of pairs of electrodes. There is a wide range of choices for electrode placement, electrical drive signal, choice of measurement electrodes, and algorithms to compare the datasets in order to derive strain, and from strain, force and other applied properties.

The electrodes 206 can be placed within the backup pad 202 as further illustrated in FIGS. 11A, 11B, 12A and 12B. In other examples they can be placed on a surface thereof. Thus, the electrodes 206 can be placed in any arrangement. Further electrodes 206 than the four shown are contemplated and the number can be 12, 24, 32, or another number, for example. The electrical signal applied between drive electrodes can be either a current or a voltage. A potential advantage of a current is that contact impedance does not have to be well controlled and the current is identical for all drive pairs. Alternatively, a voltage can be applied, and the current can be measured. The measurement can then be normalized to account for different drive currents. The system can be used with either a DC or AC applied signal.

In some examples, the electrodes 206 can be manufactured on a 'sticker' which is a piece of paper or plastic with an adhesive backing. In other words, the backup pad 202 can comprise a sticker that comprises the electrodes 206 and the controller 208, wherein the sticker adheres to a surface, a layer or another portion of the backup pad 202. Locations where the electrodes 206 are present can have a conductive adhesive. The measurement electronics (e.g., the controller 208) can also be on the sticker and can be powered via connections to an abrading tool or another component in the tool stack. In other words, the controller 208 can be powered through an electrical connection to another component in the tool stack. A communication unit 210 can send a signals that include data indicative to various measured electrical properties, strain, etc.

In addition to the electrodes 206, the applied sticker can also include an inductor for inductive coupling to another antenna in the backup pad 202. Thus, power can be provided directly to the sicker from within the backup pad 202 without the need for a physical, wired connection. Additionally, communication can be provided directly from the sticker to the backup pad 202 without the need for a physical (wired) connection. For instance, the communication unit 210 can comprise an Bluetooth interface and the controller 208 can be powered through the Bluetooth interface. On a fast-moving backup pad 202, not using a physical connection can be advantageous.

Figure 11A:
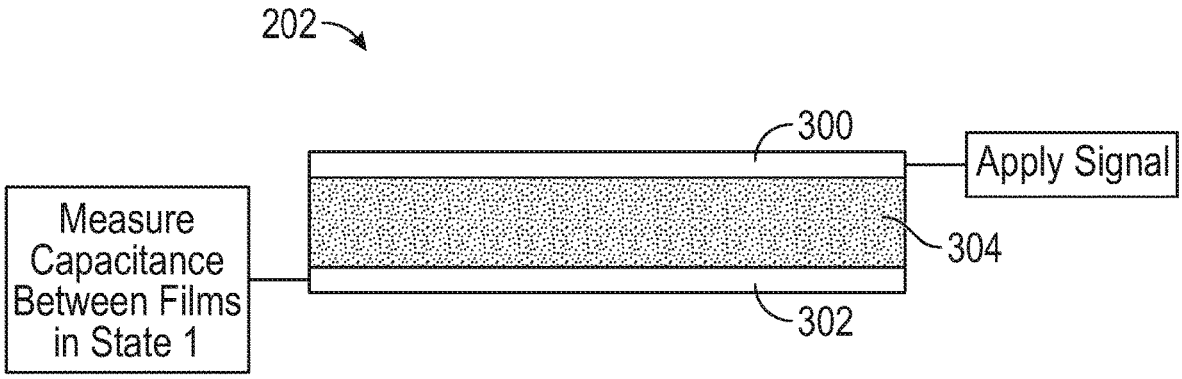
FIG. 11A is a highly schematic cross-section of the apparatus of FIG. 10 according to one example where capacitance is measured between two films separated by deformable material in a first state (no applied force), in accordance with one example of the present application.

Keeping the discussion and arrangement of the backup pad 202 in mind from FIG. 10, FIG. 11A shows an arrangement where a first film 300 of the backup pad 202 is separated from a second film 302. The films 300, 302 can be electrically conductive. In some cases, the films 300, 302 can comprise the electrodes 206 or stickers as previously described and shown in FIG. 10. The films 300, 302 can be separated from one another by a deformable material 304 such as foam, for example. In the first state of FIG. 11A, no force is applied and the deformable material 304 has a first density. In the first state of FIG. 11A, a signal as discussed in FIG. 10 is applied to the first film 300 and a first capacitance can be measured between the first film 300 and the second film 302 in the first no force state.

Figure 11B:
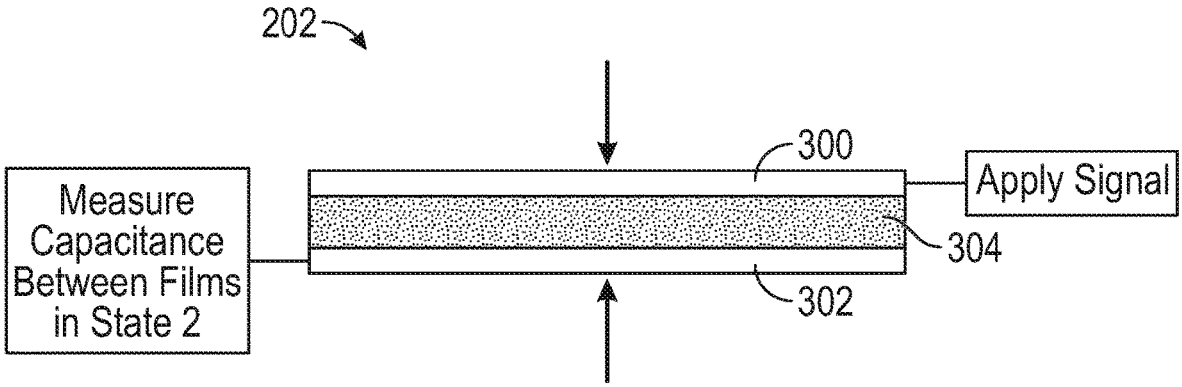
FIG. 11B is a highly schematic cross-section of the apparatus of FIG. 10 according to one example where capacitance is measured between two films separated by deformable material that is compressed in a second state (applied force), in accordance with one example of the present application.

In FIG. 11B, a force of a known or unknown amount is applied to the backup pad 202. This compresses the deformable material 304 as shown in FIG. 11B and brings the first film 300 and the second film 302 closer together which changes the capacitance between the films 300, 302. In the second state of FIG. 11B, a signal can be applied to the first film 300 and a second capacitance can be measured between the first film 300 and the second film 302 in the second force state. Values for measured capacitance between the two states can be used to derive properties such as strain, applied force, etc. as previously discussed. Measurements of the capacitance can be compared to measured capacitance for the backup pad 202 where a known force was applied to perform these calculations.

Figure 12A:
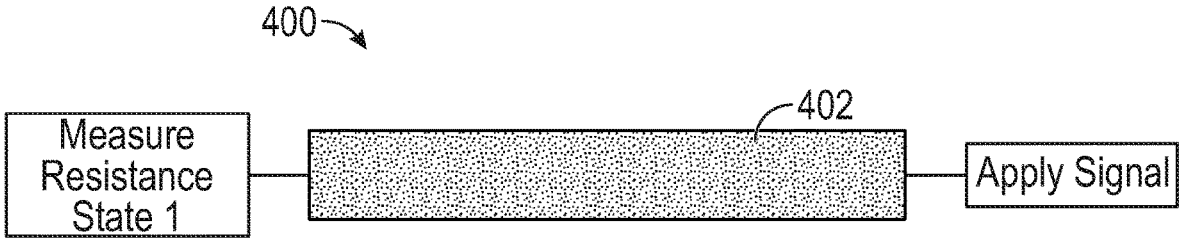
FIG. 12A is a highly schematic illustration of a conductive particle loaded foam or similar material having a first resistance measured in a first state (no applied force) in accordance with one example of the present application.
Figure 12B:
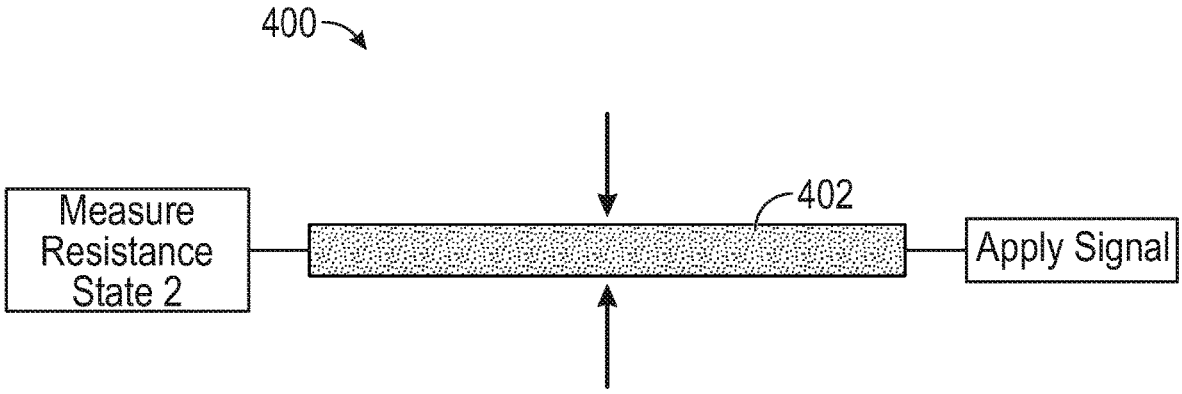
FIG. 12B is a highly schematic illustration of the conductive particle loaded foam or similar material of FIG. 12A having a second resistance measured in a second compressed state (applied force) in accordance with one example of the present application.

FIGS. 12A and 12B show another configuration for a backup pad or another apparatus 400 where a conductive particle loaded foam or similar material 402 can be utilized. For example, this material 402 can comprise a flexible elastic carbon foam (ECF)-formed by direct carbonization of melamine foams (MF) at 800° C. without using any metal catalyst as is further discussed in the publication "A flexible and highly sensitive pressure sensor based on elastic carbon foam" in the Journal of Material Chemistry C and published Jan. 15, 2018, the entire contents of which are incorporated by reference. According to another example, the material 402 can comprise XOnano Pressure sensing Smartfoam, further information accessible at http://xonanosmartfoam-.com/smartfoam-pressure/. This material can be deformable under pressure/load as shown in FIG. 12B. This material 402 has a resistance that changes as a function of density. Applying force/pressure to the apparatus 400 as shown in FIG. 12B densities the material and lowers the resistance.

Keeping the discussion and arrangement of the backup pad 202 in mind from FIG. 10, FIG. 12A shows an arrangement where no force is applied to the apparatus 400 and the material 402. In the first state of FIG. 12A, where no force is applied the material 402 has a first density. In the first state of FIG. 12A, a signal as discussed in FIG. 10 is applied to the material 402 and a first resistance can be measured in the first no force state.

In FIG. 12B, a force of a known or unknown amount is applied to the apparatus 400 and the material 402. This compresses the material 402 as shown in FIG. 12B and increases the resistance of the material 402. In the second state of FIG. 12B, a signal can be applied to the material 402 and a second resistance can be measured in the second force state. Values for measured resistance between the two states can be used to derive properties such as strain, applied force, etc. as previously discussed. Measurements of the resistance can be compared to measured resistance for the apparatus 400 where a known force was applied to perform these calculations.

Robots such as robotic device 16 can have difficulty in performing abrading tasks because they lack a human operator's intuitive feel. However, use of robots to perform abrading tasks can be highly beneficial in some situations, such as when toxic materials are involved, space is constrained, physical access to an area of a workpiece is constrained, work occurs in a hazardous area, and so on. In some instances, a computing system can use the data derived from the various sensors and techniques discussed previously in this application for training and improving the operation of robots such as robotic device 16 to perform abrading tasks such as the paint repair previously described. For example, the computing system can aggregate data from many work sessions to quantify what a worker might intuitively feel about an area of a workpiece being complete, applied force/pressure being to little in amount or to large, a CAP being worn out, etc. For instance, the computing system can determine (e.g., based on data gathered from the tool stack as previously discussed and other data such as video information, work duration information, abrading tool movement information, temperature information, and/or other data) when an area of a workpiece is complete or other information. Similar information can be used for determining whether the CAP is worn out. In some examples, computing system can train a machine learning system (further shown in FIG. 13) based on such data to make determinations regarding whether an area of a workpiece is complete and/or whether the CAP is worn out and other determinations. For instance, usage data such as the data gathered with the sensor(s) 24 and other sensors discussed herein can be used as training data for a neural network part of a machine learning routine as discussed below in FIG. 13. Furthermore, the data can be used for manufacturer monitoring of the CAP and/or the abrading tool performance for purposes of product improvement.

Figure 13:
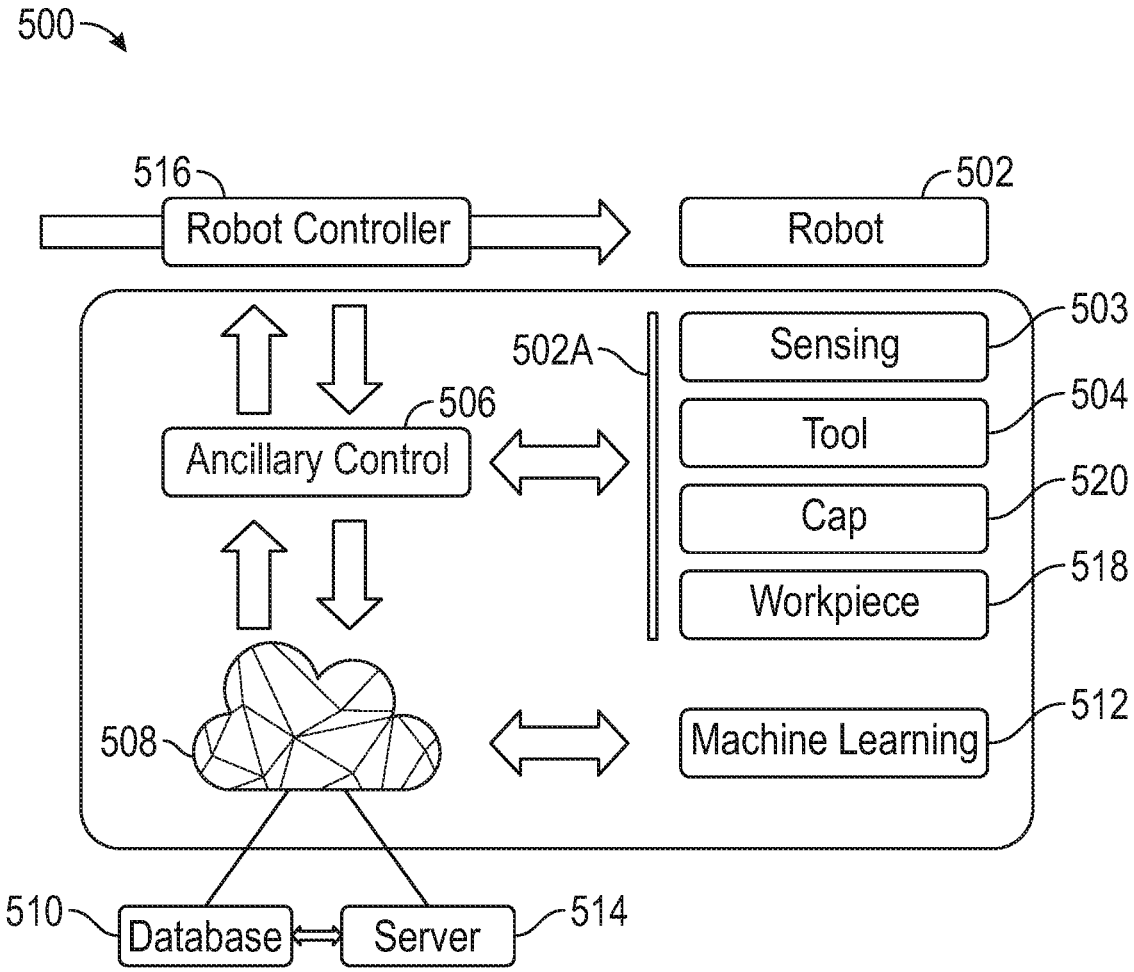
FIG. 13 is a schematic of a system for monitoring/controlling one or more of the robot, the abrading tool, the consumable abrasive product and the workpiece, the system including a learning component and cloud-based process planning and optimization, in accordance with one example of the present application.

FIG. 13 shows a sample example of a robotic implemented system 500 including a learning component and cloud-based process planning and optimization. The flow of data is depicted with arrows in FIG. 13. In the example of FIG. 13, the robotic device 502 has been augmented such that the tool stack 502A includes sensors 503. The abrading tool 504 or other components such as the backup pad discussed previously so as to comprise a smart abrading tool 504. An ancillary control unit 506 is provided as part of the system 500. Furthermore, a cloud computing system 508 including a database 510 that is local or maintained in the cloud computing system 508 and is responsible for executing and maintaining the control policy for the system 500 including the robotic device 502 including those instructions recommended by a machine learning unit 512 and maintained by an instruction server 514 is provided as part of the system 500.

The ancillary control unit 506 can take the place of the deterministic code previously residing in a robot controller or similar device and can provide the immediate real-time signals and processing for execution of the robotic device 502 and the smart abrading tool 504. In this regard, the robotic device 502 can now serve a reactionary role in the system 500 driven by the ancillary control unit 506. The database 510 of the cloud computing system 500 can serve as a long-term data repository that stores monitoring generated data of processing including state variables, measurements, and resulting performance that can be correlated with identified operating parameter deviations and/or defects to generate instructions (sometimes termed policies) implemented by the instruction server 514. Additionally, the machine learning unit 512 can be responsible for continuously improving the operating instructions based on observations (state/sensor data derived from monitoring) and subsequent reward (quality of performance). Online learning can be accomplished by a form of reinforcement learning such as Temporal Difference (TD) Learning, Deep Q Learning, Trust Region Policy Optimization, etc.

In the example of FIG. 13, the robot device 502 can be capable of sufficiently positioning the smart abrading tool 504 to achieve desired abrading described above. While lower degree of freedom systems could be used in some cases, six degree of freedom serial robot manipulators can be utilized as well. Some examples include, but are not limited to Fanuc's M-20 series, ABB's IRB 1600, or Kuka's KR 60 series. For example, the Kuka KR 60 HA has 6 axes and degrees of freedom, supports a 60 kg payload, and has a 2.033 m reach. Process-specific tooling (i.e., the smart backup pad) has been covered in extensive detail above.

A robot controller module 516 can be the robot OEM provided controller for the robotic device 502. The robot controller module 516 can be responsible for sending motion commands directly to the robotic device 502 and monitoring any operational, safety or other concerns. In practice, the robot controller module 516 can generally include a robot controller in conjunction with one or more safety programmable logic controllers (PLCs) for cell monitoring. In a sample example, the robot controller module 516 can be setup to take input from the ancillary control unit 506 that can provide performance specific information including various of the data (usage, safety, quality, etc.) discussed previously and/or commands. This can happen, depending on the desired implementation, either off-line via program downloads and execution or in real-time via streaming. An example of the offline approach would be a pre-processed robot program in the native robot's language (e.g., RAPID, KRL, Karel, Inform, etc.) that gets run by the robot controller module 516. On the other hand, example streaming interfaces would be through robot OEM provided sensor interface packages such as Fanuc's Dynamic Path Modification package or Kuka's Robot Sensor Interface. In this real-time example, the ancillary controller 506 can (described in further detail below) send on-line, real-time positional offsets to the robot controller module 516 based on gathered data derived from monitoring.

The ancillary control unit 506 can serve as the central communication hub between the smart abrading tool 504, the robotic device 502, other components of the system that can have communication units and/or sensors (e.g., a backup pad as previously discussed and shown, a workpiece 518 and/or a CAP 520) and the cloud computing system 508. The ancillary control unit 506 can receive monitoring data for the various sensors (from the backup pad, smart abrading tool 504, the workpiece 518, the CAP 520 and/or other components of the tool stack 502A) and transmits the resulting policy to the robot controller module 516 as illustrated in FIG. 13 and can control various devices including the backup pad, actuators, valves, other controllers, etc. as previously discussed. As noted above, this transmission can be either online or off-line depending on the particular implementation. The ancillary control unit 506 can be also responsible for controlling any proprietary hardware such as the force control sensors and devices, actuators, air/servo tools, sensors, and the like.

In one example, the ancillary control unit 506 can comprise an embedded (industrially hardened) process PC running a real-time/low-latency Linux kernel. Communication to the robot controller module 516 (via the KUKA. Robot-Sensorinterface) can be accomplished through UDP protocol. Communication to the various system components can be via the various communication units and modalities discussed previously in reference to FIGURES.

The robotic device 502 can include any process-specific tooling required for the objective such as force control sensors and devices, actuators, valves, other controllers sensors, etc. In general, the robotic device 502 itself may not be dexterous enough or nuanced in force application to adequately apply the correct processing forces. As such, some form of active compliance can often be necessary or desirable. Besides the force control sensors and devices such as those previously described herein, the sensors can also be desirable as in-situ inspection allows for local hi-fidelity measurements such as of a finish on the workpiece 518 at process-time along with the ability to acquire feedback mid-process, which may not be achievable with approaches using only pre-inspection and post-inspection. For example, mid-process feedback from various of the sensor previously described in reference to any of the FIGURES herein can be important to a successful learning algorithm. The sensors 503 can include any of the various sensors previously described and can be mounted on or within the backup pad, the abrading tool 504, the workpiece 518 and/or the CAP 520. Additionally, the sensors 503 can be placed in close proximity to the workplace to gather operation related data including images of objects/components in the workplace.

It is to be recognized that depending on the example, certain acts or events of any of the techniques described herein can be performed in a different sequence, can be added, merged, or left out altogether (e.g., not all described acts or events are necessary for the practice of the techniques). Moreover, in certain examples, acts or events can be performed concurrently, e.g., through multi-threaded processing, interrupt processing, or multiple processors, rather than sequentially.

In one or more examples, the functions described can be implemented in hardware, software, firmware, or any combination thereof, located locally or remotely. If implemented in software, the functions can be stored on or transmitted over a computer-readable medium as one or more instructions or code and executed by a hardware-based processing unit. Computer-readable media can include computer-readable storage media, which corresponds to a tangible medium such as data storage media, or communication media including any medium that facilitates transfer of a computer program from one place to another, e.g., according to a communication protocol. In this manner, computer-readable media generally can correspond to (1) tangible computer-readable storage media which is non-transitory or (2) a communication medium such as a signal or carrier wave. Data storage media can be any available media that can be accessed by one or more computers or one or more processors to retrieve instructions, code and/or data structures for implementation of the techniques described in this disclosure. A computer program product can include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium.

It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions can be executed by one or more processors, such as one or more digital signal processors (DSPs), general purpose microprocessors, application specific integrated circuits (ASICs), field programmable gate arrays (FPGAs), or other equivalent integrated or discrete logic circuitry, as well as any combination of such components. Accordingly, the term "processor," as used herein can refer to any of the foregoing structures or any other structure suitable for implementation of the techniques described herein. In addition, in some aspects, the functionality described herein can be provided within dedicated hardware and/or software modules. Also, the techniques could be fully implemented in one or more circuits or logic elements.

The techniques of this disclosure can be implemented in a wide variety of devices or apparatuses, including a wireless communication device or wireless handset, a microprocessor, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units can be combined in a hardware unit or provided by a collection of interoperative hardware units, including one or more processors as described above, in conjunction with suitable software and/or firmware.

The functions, techniques or algorithms described herein may be implemented in software in one example. The software may consist of computer executable instructions stored on computer readable media or computer readable storage device such as one or more non-transitory memories or other type of hardware-based storage devices, either local or networked. Further, such functions correspond to modules, which may be software, hardware, firmware or any combination thereof. Multiple functions may be performed in one or more modules as desired, and the examples described are merely examples. The software may be executed on a digital signal processor, ASIC, microprocessor, or other type of processor operating on a computer system, such as a personal computer, server or other computer system, turning such computer system into a specifically programmed machine Various examples have been described. These and other examples are within the scope of the following claims.

What is claimed is:

1. A robotic paint repair system, comprising:

a consumable abrasive product configured to abrade a substrate;

a tool configured to drive the consumable abrasive product to abrade;

a robotic device configured to manipulate the tool; and a compliant accessory actuator positioned between the tool and the substrate, wherein the compliant accessory actuator is driven to apply a desired force and a desired stiffness to the consumable abrasive product in response to sensed data collected between the tool and the substrate.

2. The robotic repair system of claim 1 further comprising:

a pressure supply;

a backup pad configured to couple with the consumable abrasive product; and a pressure controller coupled with the pressure supply, wherein the compliant accessory actuator is driven by a pneumatic pressure from the pressure supply to apply the desired force and the desired stiffness to the consumable abrasive product, and wherein the pressure controller is configured to measure an implementation force of the robotic device and is configured to control the pneumatic pressure within the pressure supply based upon the implementation force.

3. The robotic repair system of claim 2, wherein the implementation force is measured at a flange between the robotic device and the tool.

4. The robotic repair system of claim 3, further comprising a sensor configured to couple to one of the backup pad, the tool and the flange.

5. The robotic repair system of claim 2, wherein the pressure supply can be one of internal to or external of the tool.

6. The robotic repair system of claim 1, wherein the compliant force actuator comprises a plurality of internal pressure chambers encapsulated by a deformable material, and wherein the plurality of internal pressure chambers are arranged in a multitude of different configurations to achieve the desired force and desired stiffness.

7. The robotic repair system of claim 6, wherein the desired force comprises a range, and wherein the desired stiffness comprises one or more of an angular stiffness and a lateral stiffness.

8. The robotic repair system of claim 1, wherein the robotic device is directly coupled to the tool with no intermediate component.

9. The robotic repair device of claim 1, further comprising a sensor positioned in the backup pad and configured to measure a force exerted on the backup pad.

10. A system, comprising:

a consumable abrasive product configured to abrade a substrate;

a backup pad configured to couple with the consumable abrasive product such that the consumable abrasive product can be driven along with the backup pad;

a tool configured to drive the backup pad and the consumable abrasive product to abrade; and a sensor mounted on or within the backup pad such that the sensor spins along with the backup pad and the consumable abrasive article when driven by the tool, wherein the sensor is configured to measure operation related data of the backup pad that occurs during abrading the substrate with the consumable abrasive product.

11. The system of claim 10, wherein the backup pad has a recess therein, wherein the sensor is disposed in the recess in the backup pad and sealed within a deformable volume at a first relative pressure, and wherein the operation related data includes one or more of an applied force on, an applied pressure on, an applied magnetic field on, an applied acceleration on, a resistance of, a capacitance of and a rotational speed of the backup pad.

12. The system of claim 11, wherein the backup pad is formed of a deformable material that deflects under the applied force, and whereby the deformation of the backup pad causes a squeezing of the deformable volume within the recess thereby increasing a pressure within the deformable volume from the first relative pressure to a second relative pressure.

13. The system of claim 11, wherein the deformable volume is formed of an elastomeric material.

14. The system of claim 10, wherein the sensor is powered by a battery that is charged by energy harvesting as a result of the spinning and vibration of the backup pad.

15. The system of claim 10, further comprising a processor communicating wirelessly with the sensor.

16. The system of claim 10, further comprising a processor configured to determine a strain across the backup pad as a function of a change in density of the backup pad.

17. The system of claim 16, wherein the strain is determined as a function of a change in capacitance between at least to films as measured in a first state with a first amount of force is applied to the backup pad and a second state where a second force is applied to the backup pad, wherein the at least two films are separated by a deformable foam of the backup pad.

18. The system of claim 16, wherein the strain is determined as a function of a change in resistance of a conductive particle foam where a resistance of the conductive particle foam changes as a function of a change in density of the conductive particle foam.

19. The system of claim 10, further comprising:

a robotic device configured to manipulate the tool;

wherein the robotic device is configured to change an operation or a parameter related to manipulation of the tool based on data derived from the measured one or more of the applied force on, the applied pressure on, the applied magnetic field on, the applied acceleration on, the resistance of, the capacitance of and the rotational speed of the backup pad.

20. The system of claim 19, wherein the robotic device, the tool, the consumable abrasive product, and the backup pad comprise first components of a tool stack, and further comprising:

a deformable component that comprises another component of the tool stack; and a second sensor within the deformable component, wherein the second senor is configured to measure one or more of a resistance of and a capacitance of the deformable component.

* * * * *